US005256621A

United States Patent [19]

Yasuda et al.

[11] Patent Number: 5,256,621

[45] Date of Patent: Oct. 26, 1993

[54] THERMAL TRANSFER IMAGE-RECEIVING SHEET

[75] Inventors: Kenji Yasuda, Yachiyo; Toshihiro Minato; Masaru Kato, both of Tokyo; Akira Umemoto, Kasugai; Toshie Uriu, Tokyo; Norio Yamamura, Yokohama, all of Japan

[73] Assignee: Oji Paper Co., Ltd., Tokyo, Japan

[21] Appl. No.: 689,567

[22] Filed: Apr. 23, 1991

[30] Foreign Application Priority Data

Apr. 24, 1990 [JP] Japan ..... 2-106539
Apr. 26, 1990 [JP] Japan ..... 2-108839
May 31, 1990 [JP] Japan ..... 2-139816

[51] Int. Cl.[5] ..... B41M 5/035; B41M 5/38

[52] U.S. Cl. ..... 503/227; 428/195; 428/207; 428/409; 428/480; 428/913; 428/914

[58] Field of Search ..... 8/471; 428/195, 913, 428/914, 409, 207, 480; 503/227

[56] References Cited

U.S. PATENT DOCUMENTS 4,720,480 1/1988 Ito et al. ..... 503/227

*Primary Examiner*—B. Hamilton Hess
*Attorney, Agent, or Firm*—Armstrong, Westerman, Hattori, McLeland & Naughton

[57] ABSTRACT

A thermal transfer image-receiving sheet for recording thermally transferred dye images having a uniform color density (darkness) and a high clarity at a high resolution, without curling, comprises an image-receiving resinous layer formed on a front surface of a substrate sheet and comprising a dye-receiving resinous material, for example, a polyester resin, in which the image-receiving resinous layer surface has a surface roughness wave form having a maximum wave height ($R_{max}$) of 1.0 μm or less at a wave length of 0.1 to 2 μm.

24 Claims, 1 Drawing Sheet

THERMAL TRANSFER IMAGE-RECEIVING SHEET

BACKGROUND OF THE INVENTION

1) Field of the Invention

The present invention relates to a thermal transfer image-receiving sheet. More particularly, the present invention relates to a thermal transfer image-receiving sheet capable of recording thereon thermally transferred dye or ink images or pictures in a clear and sharp form without a thermal curling thereof, at a high resolution and a high tone reproductivity, and capable of being smoothly moved through a thermal printer without fear of a blockage in the thermal printer, especially a dye-thermal transfer printer.

2) Description of the Related Arts

Currently there is enormous interest in the development of new types of color printers capable of recording clear full color images or pictures, for example, relatively compact thermal printing systems, especially sublimating dye thermal transfer printers.

The small sized dye thermal transfer full color printers are expected to be widely utilized as electronic camera printers and video printers.

In the dye thermal transfer printer, colored images or pictures are formed by superimposing a dye ink sheet composed of a substrate sheet and a dye ink layer formed on the substrate sheet and comprising a mixture of a sublimating dye with a binder on a dye image-receiving sheet composed of a dye image-receiving resinous layer formed on a substrate sheet in such a manner that the ink layer surface of the ink sheet is brought into direct contact with the dye image-receiving resinous layer of the dye image-receiving sheet, and the dye ink layer is partly heated by a thermal head of a printer in accordance with an input of electric signals corresponding to the images or pictures to be printed, to thermally transfer the dye images or pictures to the dye image-receivinq resinous layer.

It is known that a dye image-receiving sheet composed of a substrate sheet consisting of, for example, a biaxially oriented film comprising a mixture of a polyolefin resin with an inorganic pigment and a dye image-receiving layer comprising a dye-receiving polymeric material, for example, a polyester resin, polycarbonate resin or acrylic resin, is useful for recording thereon clear dye images, using the thermal printer as mentioned above. The above-mentioned film has a uniform thickness, a high flexibility and a low thermal conductivity, compared with that of a cellulosic pulp paper sheet, and therefore, is advantageous in that thermally transferred colored images thereon have an even color density and a strong color depth.

Nevertheless, when the dye image-receiving sheet having a substrate sheet consisting of a thermoplastic film or an oriented plastic sheet with microvoids is subjected to a thermal transfer printing operation, the stress created by a drawing operation in the film is released, and according, a shrinking of the film or sheet occurs. This shrinkage causes a curling or wrinkling of the dye image-receiving sheet, and thus a travel of the image-receiving sheet through the printer is disturbed. Also, the resultant curled prints exhibit a poor appearance.

To eliminate the disadvantages of the conventional image-receiving sheet due to the thermal properties of the substrate sheet, an attempt has been made to provide a substrate sheet comprising a core sheet consisting of a cellulosic pulp paper sheet which exhibits a very small thermal shrinkage, and coating layers adhered to the front and back surfaces of the core sheet and consisting of a monoaxially or biaxially oriented thermoplastic film. In this case, the relatively high roughness of the core paper sheet surface has an adverse influence on the surface property of the image-receiving resinous layer formed on the substrate sheet, and thus contacts of the image-receiving resinous layer surface with the ink sheet surface, and of the ink sheet surface with the thermal head, becomes uneven. This uneven contact lowers the quality of the resultant images on the image-receiving sheet, and further, lowers the reproducibility of the continuous tone color images.

Particularly, in a full color image dye thermal transfer printing system, there is a demand for an improvement of the image-receiving sheet by which the quality of the thermally transferred colored images is enhanced.

Also, there is a strong demand for an improvement of the close contacts of the thermal head to the ink sheet, and of the ink sheet to the image-receiving resinous layer, to enhance the accuracy of the thermal transfer of the dye images and to prevent the adverse influence imposed on the thermally transferred dye images due to the large amount of heat imparted by the thermal head.

Nevertheless, these demands have yet to be satisfactorily met.

Usually, the image-receiving resinous layer is formed by coating a coating liquid containing a dye-receiving resinous material dissolved in an organic solvent, on a surface of a substrate sheet and drying the coated coating liquid layer.

For example, Japanese Unexamined Patent Publication No. 61-297185 discloses a method of forming the image-receiving resinous layer from a resin solution by using a wire bar. This method is disadvantageous in that the resultant image-receiving resinous layer surface has a number of fine irregular streaks formed by the wire bar and the resultant rough surface of the image-receiving layer is a cause of an uneven color depth of the transferred images. To avoid the above-mentioned disadvantages, the printing operation must be carried out along the coating direction of the image-receiving resinous layer.

Also, to lower the stripe-shaped surface roughness of the image-receiving resinous layer, an attempt has been made to reduce the concentration of the resinous material in the coating liquid, to lower the viscosity of the coating liquid. This attempt is disadvantageous in that a large amount of heat energy becomes necessary for drying the coated coating liquid layer and a large amount of organic solvent must be used to dilute the coating liquid, and thus the cost of the production of the image-receiving sheet is increased.

Japanese Unexamined Patent Publication No. 62-211,195 discloses a method of forming an image-receiving resinous layer by coating an aqueous coating liquid containing a dye-receiving resinous material on a substrate sheet, coagulating the resultant coating liquid layer, and drying the coagulated resinous material layer while pressing the resinous material layer onto a surface of a cast drum to form a flat image-receiving resinous layer.

This method is disadvantageous in that the apparatus necessary for forming the image-receiving resinous layer is large and costly and only the aqueous coating liquid can be utilized, the resultant image-receiving resinous layer has a poor quality, and when the resultant image-receiving resinous layer is separated from the cast drum surface, a number of fine irregular marks are formed on the surface of the resinous layer.

In the conventional image-receiving sheet, various polyester resins are employed to form the image-receiving resinous layer. For example, to provide a polyester resin having a high dye thermal transfer rate and/or a large dye-receiving capacity, an attempt has been made to lower the glass transition temperature thereof. In this attempt, a dicarboxylic acid component comprising a mixture of terephthalic acid and other dicarboxylic acid and/or a diol component comprising a mixture of ethylene glycol and other diol compound, is used to provide a copolyester resin having a relatively low glass transition temperature.

Generally, it is considered that a lowering of the glass transition temperature can bring a corresponding lowering of the thermal transfer-starting temperature of the resultant resin, and thus an increase of the thermal transfer rate of the resin.

Nevertheless, a heat transfer rate and the heating temperature must be raised to increase the sensitivity of the dye-receiving resinous material. Also, the image-receiving layer formed from a resinous material having a low glass transition temperature exhibits a low mechanical strength at a high temperature, and therefore, the resultant image-receiving sheet cannot travel smoothly through the thermal transfer printer due to a fuse-adhesion of the image-receiving resinous layer. In view of these phenomena, the low glass transition temperature causes the resultant image-receiving resinous layer to exhibit a low thermal sensitivity, and accordingly, the concept of increasing the color depth of the thermally transferred dye images by lowering the glass transition temperature of the dye-receiving resinous material is not practical.

An image-receiving resinous layer having an enhanced sticking or fuse-adhesion resistance and a satisfactory storage stability can be obtained from a resinous material having a relatively high glass transition temperature, but this type of resinous material is disadvantageous in that the resultant image-receiving resinous layer exhibits an increased dye thermal transfer-starting temperature, and therefore, a lower image-transfer sensitivity than the resinous material having the relatively low glass transition temperature.

Japanese Unexamined Patent Publication No. 62-244696 discloses a dye-receiving resinous material consisting of a polyester resin containing a copolymerized aromatic polyol compound having a phenyl group.

Usually, the substrates of the image-receiving sheet and the ink sheet are both formed of a thermoplastic resin, and accordingly when the image receiving sheet is fed into and delivered from the printer, a static charge is created on the sheet and the smooth travel of the sheet through the printer is often obstructed by the static charge thereon.

To prevent the generation of the static charge, an antistatic agent is applied to the image-receiving sheet and/or the ink sheet, but when the image receiving sheet is supplied in the form of individual cut sheets to the printer, the antistatic treatment applied only to the ink sheet cannot prevent the occurrence of a static charge of the image receiving sheet. This static charge of the image receiving sheet also obstructs the smooth travel of the sheets through the printer, and undesirably enhances the adhesion of dust thereto.

To eliminate the above-mentioned disadvantages, an antistatic agent has been applied to one surface of the image-receiving sheet, but the antistatic agent layer formed on the image-receiving resinous layer has a low antistatic activity durability, and has an adverse influence on the dye-receiving capacity of the image-receiving resinous layer.

In another attempt to solve this problem, an antistatic agent was mixed with the dye-receiving resinous material in the image-receiving resinous layer. Note, in this case, the antistatic agent must have a satisfactory compatibility with the dye-receiving resinous material.

Generally, it is preferable that the dye-receiving resinous material is hydrophobic and the antistatic agent is hydrophilic, and thus it is very difficult to find an antistatic agent compatible with the dye-receiving resinous material. If the antistatic agent is completely dissolved in the dye-receiving resinous material, the resultant image-receiving resinous layer does not exhibit an antistatic property. Also, if the antistatic agent phase is completely separated from the dye-receiving resinous material phase, the resultant image-receiving resinous layer probably will not exhibit a satisfactory antistatic property.

Furthermore, even if the antistatic agent can exhibit an antistatic activity in the image-receiving resinous layer, this effect practically results in a poor dye-receiving capacity.

Under the above-mentioned circumstances, there is a strong demand for the provision of a new type of image-receiving sheet having a high surface smoothness and a satisfactory resistance to deformation, for example, curling or wrinkling, and capable of recording thermally transferred dye images thereon, with a high clarity, a uniform color density, and a high accuracy.

SUMMARY OF THE INVENTION

An object of the present invention is to provide an image-receiving sheet having a high surface smoothness and usable for recording thereon thermally transferred dye or ink images, with an excellent clarity and a uniform color density, without a thermal deformation or curling thereof.

Another object of the present invention is to provide an image-receiving sheet usable for thermal transfer printers, including dye thermal transfer printers and melted ink thermal transfer printers.

The above-mentioned objects can be attained by the image-receiving sheet of the present-invention which comprises, a substrate sheet and at least one image-receiving resinous layer formed on at least one surface of the substrate sheet and comprising a dye-receiving resinous material, a surface of the image-receiving resinous layer having a surface roughness wave form with a maximum wave height ($R_{max}$) of 1.0 μm or less at a wave length of 0.1 to 2 mm.

DESCRIPTION OF THE PREFERRED EMBODIMENTS

The thermal transfer image-receiving sheet of the present invention comprises a substrate sheet and at least one image-receiving resinous layer formed on at least one of the front and back surfaces of the substrate sheet.

Figure 1:
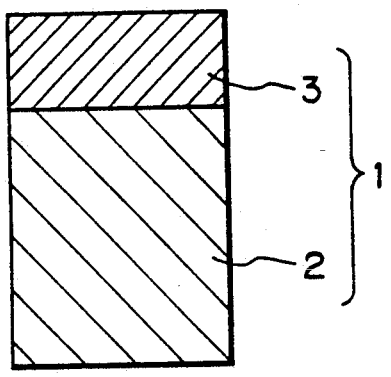
FIG. 1 is an explanatory cross-sectional profile view of an embodiment of the image-receiving sheet of the present invention.

Referring to FIG. 1, an image-receiving sheet is composed of a substrate sheet 2 and an image-receiving resinous layer 3 formed on a front surface of the substrate sheet 1.

In this embodiment, the substrate sheet is composed of a single sheet material, for example, a fine paper sheet, a coated paper sheet or a thermoplastic resinous film, and in another embodiment, the substrate sheet is composed of a core sheet and at least one thermoplastic film layer formed on at least one surface of the core sheet.

Figure 2:
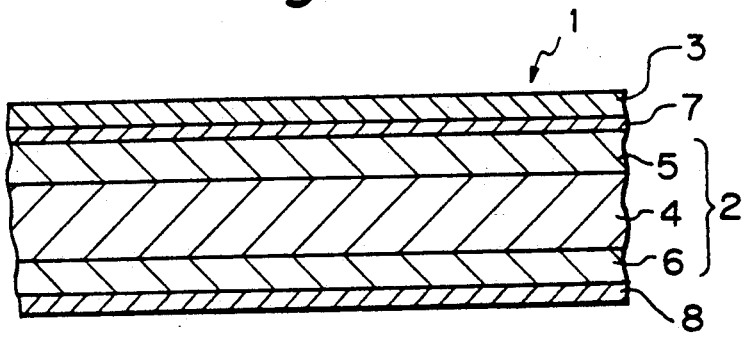
FIG. 2 is an explanatory cross-sectional profile view of another embodiment of the image-receiving sheet of the present invention; and, FIG. 3 is an explanatory view of an operation for forming an image-receiving resinous layer on a substrate sheet by a doctor blade coating method using a rotating backing drum.

FIG. 2 shows an explanatory cross-sectional profile view of another embodiment of the image-receiving sheet of the present invention, in which an image-receiving sheet 1 is composed of a substrate sheet 1 comprising a core sheet 3, a front film layer 5 formed on a front surface of the core sheet 3 and a back film layer 6 formed on a back surface of the core sheet 3, an image-receiving resinous layer 3 bonded to the front film layer 5 through an adhesive layer 7, and an additional back coating layer 8 formed on the back surface of the back film layer 6. The image-receiving resinous layer 3 may be directly bonded to the front film layer 5, in the absence of the adhesive layer 7.

The front and back film layers 5 and 6 may be bonded to the front and back surfaces of the core sheet 3 respectively through an adhesive layer.

The additional back coating layer 8 preferably comprises a synthetic resin, for example, an acrylic resin and an electroconductive material, for example, a cationic acrylic copolymer.

In the image-receiving sheet of the present invention, the surface of the image-receiving resinous layer must have a surface roughness wave form with a maximum wave height ($R_{max}$) of 1.0 μm or less at a wave length of 0.1 to 2 mm.

The wave length and the amplitude of the waves, from which the surface roughness wave form of the image-receiving resinous layer is defined, are determined by analysing electronic signals supplied from a contact needle type surface roughness tester by a frequency analyzer. The "maximum height ($R_{max}$) of waves, which represents the surface roughness, can be determined in accordance with Japanese Industrial Standard (JIS) B 0601, by using a surface roughness measuring-analyzer available from, for example, KOSAKA KENKYUSHO.

The term "surface roughness wave form" used in the specification refers to a cross-sectional wave-shaped configuration of the surface of the image-receiving resinous layer.

The surface roughness wave form of the image-receiving resinous layer of the present invention includes relatively long waves having a length of 1 mm or more and relatively short waves having a length of 0.1 to 1 mm. The relatively long waves correspond to a swelling of the surface of the image-receiving resinous layer and include, as a major component, waves having a length of 1 to 2 mm, and as a minor component, waves having a length of more than 2 mm. The relatively long waves have substantially no influence on the evenness of the color density of the transferred images.

The relatively short waves correspond to fine irregular streaks formed on the surface of the image-receiving resinous layer and are present in a large number.

The variation in the wave length is derived from a variation in the surface roughness of the substrate sheet.

The surface roughness of the substrate sheet is variable in response to the surface smoothness of the core paper sheet, which is variable in accordance with the distribution of the pulp fibers in the surface portion thereof, to the evenness in the distribution of pigment particles in the pigment-coated paper sheet, and to the uniformity of the adhesive layer formed between the image-receiving resinous layer and the substrate sheet.

In the present invention, it was found that the thermally transferred images having a satisfactory quality and evenness of the color density can be obtained by controlling the maximum height ($R_{max}$) of the waves in the surface roughness wave form to a specific level.

The inventors of the present invention tried to clarify the dependence of the uniformity in the image color density and the continuous color tone reproducibility on the surface roughness, and as a result found that, when having a surface roughness wave form with a maximum wave height ($R_{max}$) of 1.0 μm or less at a wave length of 0.1 to 2 mm, the resultant image-receiving resinous layer exhibits an enhanced uniformity of the transferred images and an improved continuous color tone reproducibility.

To provide the image-receiving resinous layer having the surface roughness wave form with a maximum wave height ($R_{max}$) of 1.0 μm or less at a wave length of 0.1 to 2 mm, it is important to enhance the surface smoothness of the substrate sheet, and the uniformity thereof.

In the image-receiving sheet of the present invention, the image-receiving resinous layer comprises a dye-receiving resinous material capable of being dyed with dyes, preferably with sublimating dyes. The dye-receiving resinous material comprises at least one member selected from polyester resins, epoxy resins, polycarbonate resins, polyamide resins, acrylic resins polyvinyl acetate resins, polyvinyl chloride resins and cellulose derivative resins, more preferably saturated polyester resins, for example, Vylon 200 (trademark, made by Toyobo K.K.).

The image-receiving resinous layer preferably has a basis weight of 3 to 12 g/m$^2$ and a thickness of 1 to 20 μm, preferably 4 to 10 μm.

The image-receiving resinous layer is bonded to a surface of the substrate sheet through an adhesive layer, or without using the adhesive layer.

The image-receiving resinous layer optionally comprises an additive comprising at least one member selected from anti-blocking agents, for example, silicone compounds, inorganic and organic pigments, antioxidants and ultraviolet absorbants, sensitizing agents, brightening agents, in response to desired properties of the image-receiving resinous layer, for example, a high storage durability against heat, light or oxidation, opacity, whiteness and brightness, in a customary amount.

In an embodiment of the image-receiving sheet of the present invention, the substrate sheet comprises a core sheet and two film layers respectively formed on the front and back surfaces of the core sheet, each comprising a single or multiple layered, monoaxially or biaxially oriented resinous film comprising, as a principal component, a mixture of a polyolefin resin with an inorganic pigment.

Preferably, the core sheet has a surface thereof, on which the image-receiving resinous layer is located through the film layer, having a Bekk smoothness of 1000 seconds or more.

The core sheet usable for the present invention comprises a member selected from fine paper sheets, coated paper sheets, and thermoplastic resin films and sheets. The core sheet must have a surface, on which the image-receiving resinous sheet is formed, having a high surface smoothness and a good uniformity. Accordingly, where the core sheet is composed of a paper sheet, to prevent a formation of flocks of pulp fibers on the surface thereof, and to thus improve the surface smoothness and thickness uniformity thereof, it is preferable to treat the paper sheet with a machine calender or a supercalender.

More preferably the surface of the paper sheet is coated with a coating layer comprising a mixture of, a pigment composed of at least one member selected from inorganic pigments, for example, calcium carbonate, kaolin, titanium dioxide, amorphous silica, magnesium carbonate, and barium sulfate, and organic pigments, for example, urea-formaldehyde resin powder, polystyrene resin powder, and styrene-acrylic ester copolymer resin powder, with a binder comprising at least one member selected from aqueous emulsions of styrene-buradiene copolymer resins, acrylic resins, polystyrene resins, polyvinyl acetate resins, polyvinylidene chloride resins, and water-soluble resins, for example, polyvinyl alcohol resins, polyamide resins, urea-formaldehyde resins, melamine-formaldehyde resins, polyacrylamide resins and starch, and the surface of the coated paper sheet is smoothed to provide a coated paper sheet.

The surface roughness of the image-receiving resinous layer is influenced by the surface smoothness of the core sheet. Therefore, as mentioned above, the surface of the core sheet preferably has a Bekk smoothness of 1000 seconds or more. If the Bekk smoothness is less than 1000 seconds, it sometimes becomes difficult to form the image-receiving resinous layer having the specific surface roughness wave form of the present invention of the resultant substrate sheet through the front film layer.

The synthetic resin film usable for the core sheet is preferably selected from polyester, polyamide, polyolefin, polystyrene, polycarbonate, polyvinyl alcohol and polyvinyl chloride films or sheets.

Usually, the core sheet has a thickness of 4 to 300 μm, preferably 10 to 200 μm.

When the thickness of the core sheet is less than 4 μm, the resultant substrate sheet sometimes exhibits an unsatisfactory stiffness or mechanical strength. Also, a thickness of more than 300 μm of the core sheet sometimes causes the resultant image-receiving sheet to be too thick and too stiff, and thus it cannot be used for a smooth printing.

Each of the front and back film layers formed on the front and back surface of the core sheet are formed from a single or multiple layered, monoaxially or biaxially oriented thermoplastic resin film comprising, as a principal component, a mixture of an inorganic pigment and a polyolefin resin. This type of oriented film or sheet is usually opaque or semi opaque and employed for printing, writing, and packaging purposes.

It is known that the above-mentioned oriented film or sheet is usable as a substrate for a sublimating dye thermal transfer image-receiving sheet capable of recording thereon clear and uniform colored images.

Nevertheless, when the oriented film per se is used as a substrate, the resultant image-receiving sheet is often curled or wrinkled during the thermal transfer printing procedure, due to the poor thermal resistance thereof.

To eliminate this disadvantage, the substrate is provided by forming front and back film layers from single layered or multiple layered, monoaxially or multiaxially oriented films each comprising, as a principal component, a mixture of a polyolefin resin with an inorganic pigment, on the front and back surfaces of a core sheet.

The polyolefin resin usable for the front and back film layers preferably comprises at least one member selected from polyethylene resins, polypropylene resins and ethylene-α-olefin copolymers. The α-olefin is selected from propylene, 1-butene and 1-pentene.

The inorganic pigment usable for the front and back film layers comprises at least one member selected from calcium carbonate, titanium dioxide and silica.

The pigment is present in an amount of 1 to 65% based on the weight of the polyolefin resin in the front or back film layer.

The single or multiple layered films usable for the front or back film layer are available, for example, under the trademark of YUPO from OJI YUKA GOSEISHI K.K. The multiple layered films include a three-layered film composed of a biaxially oriented base film layer and two monoaxially or biaxially oriented paper-like film layers respectively laminated and bonded to the front and back surfaces of the base film layer. Also, the multilayered film may have a four-or more-layer structure and contain one or more additional polyolefin resin layers which optionally contain a pigment, in addition to the base layer and the two film layers.

In the image-receiving sheet of the present invention, a front film layer on a core sheet preferably has a thermal shrinkage not higher than a back film layer thereon, determined at a temperature of 100° C. in accordance with Japanese Industrial Standard (JIS) K 6734.

If necessary, the thermal shrinkage of the multilayered film is controlled to a desired level by heat-treating at a temperature of 70° C. to 120° C., for example, by bringing the film into contact with a heating roll to release a residual stress created in the film by a drawing operation previously applied to the film.

In consideration of the thermal curling property of the resultant image-receiving sheet, sometimes, the treatment for controlling the thermal shrinkage is preferably applied to both of the films for forming the front and back film layers. Note, even in this case, the thermal shrinkage of the front film layer should not be higher than that of the back film layer. Usually, the front film layer has a thickness of 30 to 100 μm and is not thinner than that of the back film layer to avoid the curling of the image-receiving sheet in the printing operation.

The front and back film layers are adhered to the core sheet surfaces through an adhesive agent. The adhesive agent can be selected from polyether and polyester type adhesive agents preferably having a high thermal resistance and usable for dry lamination.

In another embodiment of the image-receiving sheet of the present invention, the front surface of the substrate sheet is coated with the image-receiving resinous layer and the back surface of the substrate sheet is coated with an additional back coating layer.

The additional back coating layer comprises a synthetic resin, for example, acrylic resin, an antistatic agent or an electroconductive material, for example, polyethyleneimine, and optionally, a white pigment. Preferably, the additional back coating layer is present in a basis weight of 0.1 to 1.5 g/m$^2$.

The image-receiving sheet of the present invention preferably has a total thickness of 50 to 400 μm, more preferably 50 to 200 μm, which is variable in response to the intended use of the sheet.

In another embodiment of the image-receiving sheet of the present invention, the image-receiving resinous layer is formed by coating a coating liquid comprising the dye-receiving resinous material on the surface of the substrate sheet by a doctor blade coating method, and drying the coated coating liquid layer, and the surface of the image-receiving resinous layer satisfies the relationship (I):

$$1.05 \geqq G_t/G_y \geqq 0.75 \quad \text{(I)}$$

preferably the relationship (Ia):

$$1 \geqq G_t/G_y = 0.80$$

wherein $G_t$ represents a gloss of the image-receiving resinous layer surface measured along the doctor blade coating direction, and $G_y$ represents a gloss of the image-receiving resinous layer surface measured along a direction at a right angle to the doctor blade coating direction, and has a Bekk smoothness of 500 seconds or more.

Figure 3:
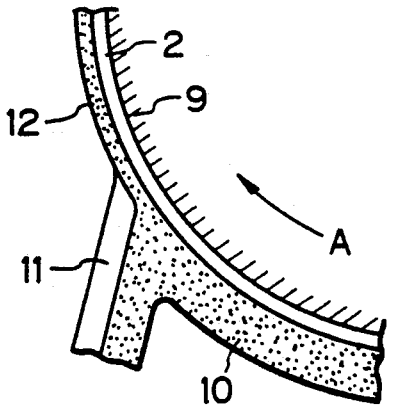

The doctor blade coating operation can be carried out as indicated in FIG. 3.

As shown in FIG. 3, a substrate sheet 2 is fed onto a periphery of a backup roll 9 rotating in the direction as shown by an arrow A, to thus rotate together with the backup roll 9.

A coating liquid 10 is coated on the surface of the rotating substrate sheet 2 and a doctor blade 11 regulates the thickness of the coated coating liquid layer 12 to a desired value. Then, the coated coating liquid layer 12 is solidified by drying, to form an image-receiving resinous layer. The doctor blade is preferably selected from customary knife blades, a bent blade made from a flexible blade, and a roll doctor blade with or without cutouts.

In a microscopic view, the surface smoothness of the image-receiving resinous layer sometimes becomes uneven in response to the coating method and the viscosity of the coating liquid. For example, when the coating liquid is applied to a substrate sheet surface by a coating wire bar, the resultant image-receiving resinous layer surface sometimes has fine irregular streaks. This unevenness in the surface smoothness causes the transferred images to have a remarkably uneven color density, and causes shearing in the picture elements.

In this image-receiving resinous layer surface, the glossiness measured along the coating direction is different from the gloss measured at a right angle to the coating direction. Usually, the glossiness in the coating direction is higher than the glossiness at a right angle to the coating direction. The unevenness of the surface can be represented by the ratio $G_t/G_y$; when the surface is completely isotropic, the ratio $G_t/G_y$ is equal to 1. In practice, the ratio $G_t/G_y$ of the image-receiving resinous layer surface varies dependent on the coating method, coating speed, the viscosity and concentration of coating liquid, surface conditions of the substrate sheet, and other factors.

In the present invention, the ratio $G_t/G_y$ is preferably 1.05 or less but not less than 0.75, more preferably 1 or less but not less than 0.80.

When the ratio $G_t/G_y$ is more than 1.05, the image dots sometimes exhibit a difference in quality between the doctor blade coating direction and the direction at a right angle to the doctor blade coating direction. When the ratio $G_t/G_y$ is less than 0.75, the quality of the image dots sometimes becomes uneven in the doctor blade coating direction.

To record high quality images having a satisfactory uniformity of the color density of the images preferably the surface of the image-receiving resinous layer has a Bekk smoothness of 500 seconds or more.

When the Bekk smoothness is less than 500 seconds, sometimes the uniformity in the color density of the images, especially light-colored images, is decreased and the continuous color tone reproducibility becomes unsatisfactory.

The glass $G_t$ or $G_y$ of the image-receiving resinous layer surface can be measured by using a reflective glossmeter at an angle of incidence of 60 degrees. Also, the Bekk smoothness of the image-receiving resinous layer surface can be determined in accordance with the method of JIS P 8119.

In the coating operation for the image-receiving resinous sheet, the coating liquid containing the dye-receiving resinous material preferably has a Newtonian viscosity of 50 cP or more, more preferably of 500 cP or more, but not more than 10,000 cP, more preferably not more than 5000 cP, at a coating temperature of, for example, 20° to 50° C. The upper limit of the viscosity of the coating liquid is determined mainly in response to the necessary level thereof under the shearing conditions applied to the coating liquid by the doctor blade. In some cases, the coating liquid viscosity may be 10,000 cP or more, depending on the shearing conditions imposed by the doctor blade.

The dye-receiving resinous material in the coating liquid is present preferably in a concentration of 5 to 50% by weight, more preferably 25 to 40% by weight. If the concentration is less than 5% by weight, a drying of the resultant coating liquid requires a large quantity of heat, and thus is uneconomical. If the concentration of the dye-receiving resinous material is more than 50% by weight, the resultant coating liquid exhibits a poor fluidity, and thus the surface smoothness and surface uniformity of the resultant coating liquid layer become unsatisfactory.

When the dye-receiving resinous material is dispersed in the form of fine particles in the coating liquid, the upper limit of the amount of the dye-receiving resinous material in the coating liquid may be higher than 50% by weight. Also, the coating liquid may consist of a cross-linking polymer, monomer, oligomer or macromer alone, without using a solvent which must be removed by evaporation when the resultant coating liquid layer is solidified.

In the above-mentioned embodiment, the dye-receiving resinous material preferably comprises a saturated polyester resin which is a polycondensation product of a saturated dicarboxylic acid component comprising at least one member selected from o-phthalic acid, isophthalic acid, terephthalic acid, adipic acid and sebasic acid with a polyol component comprising at least one member selected from ethylene glycol, propylene glycol and addition products of bisphenol A with ethylene glycol. The dye-receiving resinous material optionally comprises an epoxy resin, polyvinyl acetate, polyvinyl chloride, polycarbonate, polyamide acrylic resin or cellulose derivative, which are capable of being dyed with sublimating dyes. The dye-receiving resinous material can be used in the form of an aqueous solution or suspension or a solution in an organic solvent.

The dye-receiving resinous material is optionally cross-linked at terminal or pendant functional groups, for example, hydroxyl, carboxyl, amino or derivatives of the above-mentioned groups, with a polyfunctional cross-linking agent, for example, polyisocyanate compound, polymethylol compound or epoxy compounds. The cross-linkage of the dye-receiving resinous material effectively prevents an undesirable sticking or fuse-adhesion of the resultant image-receiving sheet with an ink sheet during the thermal transfer printing operation. Usually, the cross-linking agent is employed an amount of 0.1 to 10% based on the weight of the dye-receiving resinous material.

Also, to avoid the fuse-adhesion, the image receiving resinous layer optionally contains, in addition to the dye-receiving resinous material, a silicone compound selected from modified silicon compounds, for example, amino-modified silicon compounds, carboxyl-modified silicone compounds, epoxy-modified silicon compounds, silicone diamine compounds, and hydroxyl-modified silicon compounds. The silicone compound is employed in an amount of 0.1 to 10% based on the weight of the dye-receiving resinous material.

Further, to enhance the brightness of the image-receiving resinous layer and to improve the contrast of the images recorded on the image-receiving resinous layer, the dye-receiving resinous material is optionally mixed with a pigment comprising at least one member selected from inorganic pigments, for example, clay, kaolin, silica, aluminum hydroxide, magnesium silicate, calcium carbonate, titanium dioxide, zinc oxide and barium sulfate, and organic pigments, for example, urea-formaldehyde resins, melamine-formaldehyde resins, phenol-formaldehyde resins, isobutylene-maleic anhydride copolymer resins, polystyrene resins, polyurethane resins and methylcellulose resins. Usually, the pigment is used in an amount of 0.3 to 10% based on the weight of the dye-receiving resinous material.

In another embodiment of the image-receiving sheet of the present invention, the image-receiving resinous layer comprises, as a principal component, a dye-receiving resinous material comprising at least one member selected from polyester resins having a glass transition temperature of from 40° C. to 70° C. and a modulus of elasticity of $5\times10^8$ Pa or more at a temperature of 60° C. and cross-linked derivatives thereof. This type of image-receiving resinous layer is effective for recording thermally transferred dye images with a high color density at a high printing sensitivity, and has a high resistance to fuse-adhesion to the ink sheet during the printing operation. Also, the resultant recorded images have an excellent stability to heat and light during storage thereof.

Preferably, the dye-receiving polyester resin is a polycondensation product of a dicarboxylic acid component comprising at least terephthalic acid with a diol component ethylene glycol and at least one aromatic diol compound, and has a number average molecular weight of 8,000 or more, preferably 20,000 or more.

The polyester resin having the above-mentioned specific glass transition temperature of 40° C. to 70° C., the specific modulus of elasticity of $5\times10^8$ Pa or more at a temperature of 60° C., and preferably, a number average molecular weight of 8,000 or more, exhibits an enhanced dye-solubility and dye-diffusibility, and therefore, can be used as the dye-receiving resinous material.

Preferably, the above-mentioned polyester resin has a modulus of elasticity of $1\times10^9$ Pa or more at a temperature of 30° C., and of $1\times10^8$ Pa or more at a temperature of 80° C.

In the preparation of the polyester resin, the aromatic diol compound is preferably selected from bisphenol A-alklylene glycol addition products of the formula:

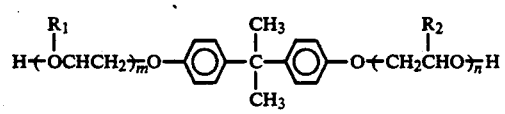

wherein $R_1$ and $R_2$, respectively and independently from each other, represent a member selected from a hydrogen atom and a methyl radical, and m and n represent, respectively and independently from each other, an integer of 1 or more and satisfy the relationship:

$$2\leqq(m+n)\leqq6.$$

The diol component preferably comprises 50 molar % or more of the aromatic diol compound, the balance consisting of ethylene glycol and at least one other diol compound.

The other diol compound is selected from aliphatic glycol compounds, for example, propylene glycol, 1,3-propane diol, 1,4-butane diol, 1,5-pentane diol, 1,6-hexane diol, diethylene glycol and dipropylene glycol, and cycloaliphatic diol compounds, for example, 1,4-cyclohexane dimethanol.

Preferably, the other diol compound is used in an amount of 70 molar % or less, more preferably 10 to 70 molar % based on the molar amount of ethylene glycol.

The dicarboxylic acid component preferably comprises 50 molar % or more, preferably 50 to 90 molar %, of terephthalic acid the balance consisting of at least one other dicarboxylic acid.

The other dicarboxylic acid can be selected from aromatic dicarboxylic acids other than terephthalic acid, for example, o-phthalic acid, isophthalic acid and 2,6-naphthalene dicarboxylic acid, aliphatic dicarboxylic acids, for example, succinic acid, adipic acid, azelaic acid, sebacic acid, dodecane-dionic acid and dimer acid and cycloaliphatic dicarboxylic acids, for example, 1,4-cyclohexane dicarboxylic acid.

The other dicarboxylic acid in the dicarboxylic acid component is present in an amount of 10 to 50 molar %.

The molecular weight of the polyester resin can be controlled to a desired value by controlling the molar proportion of the diol component to the dicarboxylic acid component, the purity of the component compounds, the side reactions and the reaction conditions, preferably, temperature and time of the polycondensation procedure.

The dye-receiving resinous material usable for the present invention optionally contains, in addition to the above-mentioned polyester resin, at least one solvent-soluble resin in an amount of 30% by weight or less.

The additional resin is selected from, for example, other polyester resins, polycarbonate resins, acrylic resins, and polyvinyl acetate resins.

The cross-linked polyester resin derivative can be produced by three-dimensionally cross-linking the polyester resins with a cross-linking agent comprising a for example, tolylene diisocyanate. The cross-linking agent has two or more functional radicals, for example, isocyanate radicals, reactive to the polyester resins, and is employed in an amount of 3 to 20 molar equivalents of the functional radicals per mole of the polyester resins.

When the cross-linking agent is used in a large amount of more than 20 molar equivalents of the functional radicals, the resultant derivative is excessively cross-linked and exhibits a lowered dye-receiving property. When the cross-linking component is used in a small amount of less than 3 molar equivalents of the functional groups, the resultant cross-linking effect is unsatisfactory.

In another embodiment of the image-receiving sheet of the present invention, the dye-receiving resinous material contained, as a principal component, in the image-receiving resinous layer comprises at least one member selected from polymers having recurring ester units and exhibiting a melt viscosity of $10^6$ Pa.S or more at a temperature of 140° C. and of $10^5$ Pa.S or more at a temperature of 160° C., and cross-linked derivatives thereof.

When the above-mentioned ester unit containing polymer is used, the resultant image-receiving resinous layer exhibits an enhanced resistance to fuse-adhesion to the ink sheet during the thermal transfer printing operation and the recorded dye images are firmly fixed to the image-receiving resinous layer.

The above-mentioned ester unit-containing polymers preferably have a number average molecular weight of 10,000 or more and a glass transition temperature of 50° C. or more.

The cross-linked polyester derivatives are preferably cross-linking reaction products of the above-mentioned ester unit-containing polymers with a cross-linking agent having two or more functional groups, for example, isocyanate radicals, reactive to the polyester resins, and in an amount of 1 molar equivalent or more, preferably 3 to 20 molar equivalents of the functional groups, per mole of the ester unit-containing polymers.

The ester unit-containing polymers usable for the present invention are preferably selected from polyesters consisting of polycondensation products of dicarboxylic acid components comprising at least terephthalic acid with diol components comprising ethylene glycol and at least one aromatic diol compound, polyacrylic esters and polyvinyl acetates.

The polyesters usable for the embodiment can be selected from the same polyester resins as those usable for the above-mentioned embodiment.

In still another embodiment of the image-receiving sheet of the present invention, an electroconductive intermediate layer is arranged between the substrate sheet and the image-receiving resinous layer. This electroconductive intermediate layer preferably comprises, as a principal component, at least one cationic resin selected from electroconductive acrylic and methacrylic copolymer resins.

In the above-mentioned type of image-receiving sheets, the image-receiving resinous layer can exhibit a low surface inherent resistivity of $10^{11}$ Ω.cm or less at a temperature of 20° C. and at a relative humidity (RH) of 50%.

This type of image-receiving sheet can be produced and printed without any difficulty derived from electrostatic charge generated on individual image-receiving sheets due to the friction between the front and back surfaces thereof during the thermal transfer printing operation.

Generally, the image-receiving resinous layer has a smaller thickness than that of the substrate sheet, and thus the electrocharging property of the image-receiving resinous layer is greatly influenced by the properties of the substrate sheet and the interface between the image-receiving resinous layer and the substrate sheet. The electrocharging property of the image-receiving resinous layer can be reduced by forming the electroconductive intermediate layer between the image-receiving resinous layer and the substrate sheet.

In conventional image receiving sheets having a substrate sheet consisting of a plastic resin film, sometimes an antistatic treatment is applied to the substrate sheet. This antistatic treatment does not, however, always satisfactorily prevent the electrocharging of the image-receiving resinous layer.

When an image-receiving resinous layer directly laminated on a substrate sheet exhibits a surface inherent resistivity of $10^{13}$ Ω.cm or more at 20° C. and at 50%RH, the arrangement of an electroconductive intermediate layer between the image-receiving resinous layer and the substrate sheet in accordance with the present invention causes the surface inherent resistivity of the image-receiving resinous layer to be lowered to a level of $10^{11}$ Ω.cm or less, preferably $10^{10}$ Ω.cm or less.

The cationic electroconductive resins usable for the present invention can be prepared by copolymerizing an acrylic or methacrylic ester with a cationic monomer, for example, vinylpyridine, ethyleneimine, N,N-diethyl-aminoethyl acrylate.

The cationic resins are available under the trademarks of SAFTOMER ST-1000, ST-2100 ST-3100, from MITSUBISHI YUKA K.K.

Preferably, the electroconductive intermediate layer is present in a dry weight of 0.05 to 3.0 g/m$^2$, more preferably 0.2 to 1.0 g/m$^2$.

When the dry weight is less than 0.05 g/m$^2$, the antistatic effect of the resultant electroconductive intermediate layer is sometimes unsatisfactory. Also, an excessive weight of more than 3.0 g/m$^2$ does not contribute to a further enhancing of the antistatic effect of the resultant electroconductive intermediate layer, and this is wasteful and sometimes causes a lowering of the bonding strength of the image-receiving resinous layer to the substrate sheet.

Also, the electroconductive intermediate layer effectively prevents an undesirable absorption of dust on the image-receiving resinous layer surface, and enhances the travelling property of the resultant image-receiving sheets in the printer.

The electroconductive intermediate layer optionally contains a binder comprising a water-soluble or hydrophilic polymeric material, for example, polyvinyl alcohol, polyacrylamide or polyethyleneimine, which is compatible with the cationic resin, to improve the bonding strength of the electroconductive intermediate layer to the substrate sheet and to the image-receiving resinous layer.

The binder is usually employed in an amount of 50% or less, preferably 20% or less, based on the total weight of the electroconductive intermediate layer.

In another embodiment of the image-receiving sheet of the present invention, an antistatic agent is coated on the image-receiving resinous layer or mixed with the dye-receiving resinous material. The antistatic agent preferably comprises a cationic polymer, for example, cationic acrylic copolymer.

Alternatively, the antistatic agent is coated on the back surface of the image-receiving sheet.

EXAMPLES

The present invention will be further explained with reference to the following specific examples.

In the examples, the image-receiving performance (color continuous tone reproducibility and uniformity of the color density of images) and the thermal curling property of the resultant image-receiving sheets were tested and evaluated in the following manner.

The image-receiving sheets (dimensions: 120 mm × 120 mm) were subjected to a printing operation using a sublimating dye thermal transfer printer available under the trademark of COLOR VIDEO PRINTER VY-50, from HITACHI LTD.

In the sublimating dye thermal transfer printer, fresh yellow, magenta and cyan dye ink sheets (Trademark: VY-S100, HITACHI LTD.) were used.

A thermal head of the printer was heated stepwise at predetermined energy levels, and the heat-transferred images were formed in a single color or a mixed (superposed) color provided by superposing yellow, magenta and cyan colored images, on the test sheet.

In each printing operation, the clarity (sharpness) of the images, the evenness of the color density, the color continuous tone reproducibility of the printed images, and the resistance of the sheet to thermal curling were observed by the naked eye, and evaluated as follows:

| Class | Evaluation |
|---|---|
| 5 | Excellent |
| 4 | Good |
| 3 | Satisfactory |
| 2 | Not satisfactory |
| 1 | Bad |

The maximum height ($R_{max}$) in the surface roughness 10 wave form of the image-receiving sheets at a wave length of 0.1 to 2 mm was measured by using a surface roughness analyzer made by KOSAKA KENKYUSHO.

The transfer printing sensitivity, the highest color density of the printed images, and the resistance to sticking or fuse-adhesion of the image-receiving sheets were tested and evaluated in the following manner.

The image-receiving sheets were subjected to a color test pattern printing operation by using a sublimating dye thermal transfer printer available under the trademark of COLOR VIDEO PRINTER UP-5000 from SONY CORP. The transfer printing, sensitivity was represented by a color density of the printed images measured by a MacBeth Color Densitometer RD-914.

The resistance to fuse adhesion was evaluated by observing the image-receiving sheet printed in a color tone pattern.

Further, the storage durability of the printed colored images was tested by heating the printed image-receiving sheets at a temperature of 60° C. for 48 hours and then observing the changes in color density and hue of the images.

The results of the tests were graded as the same five classes as mentioned above.

The thermal shrinkage of the sheet or film was determined by heating at a temperature of 100° C. for 30 minutes in accordance with JIS K 6734.

EXAMPLE 1

A multilayered sheet having microvoids formed therein, available under the trademark of YUPO FPG 60 from OJI YUKA GOSEISHI K.K., composed of a monoaxially oriented resinous film and two biaxially orient resinous films each consisting of a mixture of a polyolefin resin with an inorganic pigment, and having a thermal shrinkage of 0.5% in the longitudinal direction of the sheet and a thickness of 60 μm, was heat treated at a temperature of 80° C. for 100 hours to reduce the thermal shrinkage of 0.5% to 0.2%.

The heat treated YUPO FPG 60 sheet had a thickness of 59 μm and was used to form a front film layer of a substrate sheet. Also, a non-heat treated YUPO FPG 60 sheet was used to form a back film layer of the substrate sheet.

A coated paper sheet with a front surface thereof having a Bekk smoothness of 1900 seconds and a thickness of 58 μm was employed as a core sheet of the substrate sheet.

The substrate sheet was prepared by dry laminating the heat-treated YUPO FPG 60 sheet on the front surface of the core sheet and the non-heat-treated YUPO FPG 60 sheet on the back surface of the core sheet each through a polyester adhesive layer.

The front film layer surface of the resultant substrate sheet was coated with a coating liquid consisting of a solution of a dye-receiving polyester resin available under the trademark of VYLON 200, from TOYOBO LTD., in toluene, and the resultant coating liquid layer was dried to provide an image-receiving resinous layer having a basis weight of 5 g/m$^2$, whereby a sublimating dye thermal transfer image-receiving sheet was obtained.

The test results are indicated in Table 1.

EXAMPLE 2

The same procedures as in Example 1 were carried out except that the core sheet consisted of a polyester film available under the trademark of LUMILER 38 from TORAY INDUSTRIES Inc., and having a Bekk smoothness of 10000 seconds or more and a thickness of 38 μm, and the image-receiving resinous layer was prepared from a polyester available under the trademark of VYLON 290, from TOYOBO CORP.

The test results are shown in Table 1.

COMPARATIVE EXAMPLE 1

The same procedures as in Example 1 were carried out with the following exceptions.

The core sheet consisted of a coated paper sheet having a Bekk smoothness of 700 seconds and a thickness of 55 μm.

The test results are shown in Table 1.

COMPARATIVE EXAMPLE 2

The same procedures as in Example 1 were carried out, with the following exceptions.

The core sheet consisted of a coated paper sheet having a Bekk smoothness of 500 seconds and a thickness of 75 μm. The non-heat treated YUPO FPG 60 sheets were dry-laminated to the front and back surfaces of the core sheet.

The test results are shown in Table 1.

TABLE 1

| Example No. | Item: $R_{max}$ at wave length of 0.1 to 2 mm (μm) | Evenness of color depth of images | Middle color tone reproducibility | Resistance to curling |
|---|---|---|---|---|
| Example | | | | |
| 1 | 0.89 | 4 | 4 | 5 |
| 2 | 0.80 | 5 | 5 | 5 |
| Comparative Example | | | | |
| 1 | 1.91 | 2 | 2 | 4 |
| 2 | 2.02 | 1 | 1 | 2 |

EXAMPLE 3

A biaxially oriented, multilayered resinous film having microvoids formed therein (available under the trademark of YUPO FPG 150 from OJI YUKA GOSEISHI K.K.) consisting of a mixture of a polypropylene resin with calcium carbonate pigment and having a Bekk smoothness of 1200 seconds and a thickness of 150 μm, was employed as a substrate sheet.

A coating liquid was prepared by dissolving of a mixture of 100 parts by weight of a dye-receiving polyester resin (VYLON 200) with a 5 parts by weight of a polyisocyanate compound (available under the trademark of COLONATE L from NIHON POLYURETHANE INDUSTRIES CO., in toluene. This coating liquid had a solid concentration of 20% by weight and a Newtonian viscosity of 300 cP at 20° C.

The coating liquid was coated on a front surface of the substrate sheet by using a rigid blade doctor coater, and the resultant coating liquid layer was dried to form an image-receiving resinous layer with a dry solid basis weight of 5 g/m$^2$.

An image-receiving sheet was obtained, and the ratio $G_l/G_y$ of the image-receiving resinous layer was as indicated in Table 2.

The other test results are also shown in Table 2.

EXAMPLE 4

The same procedures as in Example 3 were carried out, with the following exceptions.

A coated paper sheet having a basis weight of 72 g/m$^2$, a thickness of 62 μm and a Bekk smoothness of 1300 seconds was employed as a substrate sheet.

The image-receiving resinous layer had a basis weight of 15 g/m$^2$.

The test results are shown in Table 2.

EXAMPLE 5

The same procedures as in Example 3 were carried out, with the following exceptions.

The substrate sheet was prepared in the following manner.

A fine paper sheet (available under the trademark of OK FORM PAPER from OJI PAPER CO.) having a basis weight of 64 g/m$^2$, a maximum wave height ($R_{max}$) of 2.5 μm at a wave length of 0.1 to 2 mm was used as a core sheet.

Two biaxially oriented porous polyolefin films (available under the trademark of TOYOPAL from TOYOBO CORP.) having a thickness of 50 μm were dry laminated on and bonded to the front and back surfaces of the core sheet through a polyester type adhesive agent, to provide a substrate sheet.

A coating liquid having a dry solid concentration of 30% by weight was prepared from a mixture of 100 parts by weight of a polyester resin aqueous dispersion (available under the trademark of VILONAL MD 1200, from TOYOBO CORP.) with 5 parts by weight of kaolin. This coating solution had a Newtonian viscosity of 150 cP.

The coating liquid was coated on a surface of the substrate sheet by using a roll doctor blade having cutouts.

The resultant image-receiving resinous layer had a basis weight of 5 g/m$^2$.

The test results of the resultant image-receiving sheet are shown in Table 2.

COMPARATIVE EXAMPLE 3

The same procedures as in Example 3 were carried out except that the doctor blade coating method was replaced by a roll coating method.

The test results are shown in Table 2.

COMPARATIVE EXAMPLE 4

The same procedures as claimed in Example 4 were carried out, with the following exceptions.

In the formation of the image-receiving resinous layer, a wire bar coating method using a wire #28 was used instead of the doctor blade coater.

The test results are shown in Table 2.

COMPARATIVE EXAMPLE 5

The same procedures as in Example 5 were carried out, except that in the step of the image-receiving resinous layer formation, a wire bar coater (wire #24) was used instead of the doctor blade coater.

The test results are shown in Table 2.

TABLE 2

| Example No. | Item: Recorded images: Color brightness | Uniformity in color density | Color continuous tone reproducibility | Image-receiving resinous layer: $R_{max}$ (μm) | Gloss ratio $G_l/G_y$ | Bekk smoothness (second) |
|---|---|---|---|---|---|---|
| Example 3 | 5 | 5 | 5 | | 0.80 | 3000 |
| Example 4 | 5 | 4 | 4 | | 1.04 | 1000 |
| Example 5 | 4 | 4 | 5 | | 0.92 | 4500 |
| Comparative Example 3 | 4 | 2 | 2 | | 1.10 | 500 |
| Comparative Example 4 | 3 | 1 | 1(*) | | 1.25 | 200 |

TABLE 2-continued

| | Item | | | | | |
|---|---|---|---|---|---|---|
| | Recorded images | | | Image-receiving resinous layer | | |
| Example No. | Color brightness | Uniformity in color density | Color continuous tone reproducibility | $R_{max}$ (μm) | Gloss ratio $G_t/G_y$ | Bekk smoothness (second) |
| Comparative Example 5 | 3 | 1 | 1 | | 1.01 | 400 |

Note: (*) . . . Very bad

SYNTHESIS EXAMPLE 1

Preparation of Copolyester Resin-1

| Compound | Amount |
|---|---|
| (1) Composition of dicarboxylic acid component | |
| Terephthalic acid | 70 molar % (116.3 g) |
| Isophthalic acid | 30 molar % (49.9 g) |
| (2) Composition of diol component | |
| Ethylene glycol | 25 molar % (15.5 g) |
| Neopentyl glycol | 5 molar % (5.8 g) |
| Aromatic diol | 70 molar % (280.0 g) |

The aromatic diol was available under the trademark of UNIOL DA 400 (the molecules total number (m+n) of ethylene glycol addition reacted to bisphenol A was 4.0), from NIHON YUSHI K.K.)

The dicarboxylic acid component and the diol component were reacted with each other in the presence of a small amount of a catalyst consisting of calcium acetate and antimony trioxide in a nitrogen gas atmosphere, by heating the reaction system to a temperature of 150° C. and maintaining this temperature for one hour, and then further heating the reaction system at a temperature of 250° C. under a vacuum of 0.1 mmHg for 2 hours, while removing non-reacted ethylene glycol from the reaction system. A copolyester resin-1 was obtained.

The copolyester resin had a number average molecular weight of 22,500 determined by a GPC, and glass transition temperature and moduluses of elasticity at temperatures of 30° C., 60° C. and 80° C. as shown in Table 3.

The glass transition temperature was measured by using a DSC and the moduluses of elasticity were measured by using an AD method free attenuation vibration system viscoelasticity-measuring apparatus available under the trademark of VISCO ELASTICITY TESTER RD 1100, from RESCA K.K.

SYNTHESIS EXAMPLE 2

Preparation of Copolyester-2

A copolyester-2 was prepared in the same manner as in Synthesis Example 1, with the following exceptions.

The diol component had the following compositions.

| Compound | Amount |
|---|---|
| Ethylene glycol | 30 molar % (18.6 g) |
| Neopentyl glycol | 10 molar % (11.6 g) |
| UNIOL DA 400 | 70 molar % (240.0 g) |

The resultant copolyester had a number average molecular weight of 18,000.

The glass transition temperature and the moduluses of elasticity at 30° C., 60° C. and 80° C. are shown in Table 3.

Comparative Polyester Resins

Comparative Polyester Resin-3

Trademark: VILON 290 made by TOYOBO CORP.

Number average molecular weight: 24,000

Comparative Polyester Resin-4

Trademark: POLYESTER 1051T, made by ARAKAWA KAGAKU K.K.

Number average molecular weight: 25,300

The glass transition temperatures and the moduluses of elasticity at 30° C., 60° C. and 80° C. of the comparative polyester resins-3 and 4 are shown in Table 3.

TABLE 3

| | | Item | | | |
|---|---|---|---|---|---|
| | | Glass transition temperature | Modulus of elasticity | | |
| Resin | | (Tg) (°C.) | 30° C. | 60° C. | 80° C. |
| Copolyester resin | 1 | 50 | $4.2 \times 10^9$ | $1.0 \times 10^9$ | $2.4 \times 10^8$ |
| Copolyester resin | 2 | 49 | $2.3 \times 10^9$ | $7.0 \times 10^8$ | $1.5 \times 10^8$ |
| Comparative polyester | 3 | 48 | $2.7 \times 10^9$ | $3.5 \times 10^8$ | $7.4 \times 10^7$ |
| Comparative polyester | 4 | 31 | $1.1 \times 10^9$ | $1.0 \times 10^8$ | $6.5 \times 10^7$ |

EXAMPLE 6

A substrate sheet was prepared by coating the front and back surfaces of a core sheet consisting of a fine paper sheet having a basis weight of 64 g/m$^2$ with front and back polyethylene film layers having a thickness of 30 μm.

The front surface of the core sheet had a Bekk smoothness of 75 seconds.

A coating liquid-1for an image-receiving resinous layer was prepared in the following composition.

| Component | Weight |
|---|---|
| Copolyester resin-1 | 100 g (0.0051 mole) |
| Cross-linking agent(*)1 | 5 g (0.024 molar equivalent) |
| Silicone resin(*)2 | 3 g |
| Toluene | 200 g |
| Methylethylketone | 200 g |

Note:
(*)1 . . . This consisted of a tri-functional isocyanate compound having a molecular weight of 638 and available under the trademark of CORONATE L, from NIHON POLYURETHANE KOGYO K.K.
(*)2 . . . This was available under the trademark of SILICONE SH 3476, from TORAY SILICONE K.K.

The front film layer surface of the substrate sheet was coated with the coating liquid by a roller doctor coater and dried to provide an image-receiving resinous layer having a dry basis weight of 5 g/m$^2$.

The resultant image-receiving sheet was subjected to the thermal transfer printing operation by using the color video printer (SONY, UP-5000).

The test results are shown in Table 4.

EXAMPLE 7

The same procedures as in Example 6 were carried out except that the coating liquid-1 was replaced by a coating liquid-2 having the following composition.

| Component | Weight |
|---|---|
| Copolyester resin-2 | 100 g |
| Silicon resin (SH 3476) | 3 g |
| Toluene | 200 g |
| Methylethylketone | 200 g |

The test results are shown in Table 4.

COMPARATIVE EXAMPLE 6

The same procedures as in Example 6 were carried out except that the coating liquid was replaced by a comparative coating liquid having the following composition.

| Component | Weight |
|---|---|
| Comparative polyester resin-3 | 100 g (0.0042 mole) |
| Cross-linking agent (CORONATE L) | 5 g (0.024 molar equivalent) |
| Silicone resin (SH3476) | 3 g |
| Toluene | 200 g |
| Methylethylketone | 200 g |

The test results are shown in Table 4.

COMPARATIVE EXAMPLE 7

The same procedures as in Example 6 were carried out except that the coating liquid was replaced by a comparative coating liquid having the following composition.

| Component | Weight |
|---|---|
| Comparative polyester resin-4 | 100 g (0.0040 mole) |
| Silicone resin (SH3476) | 3 g |
| Toluene | 200 g |
| Methylethylketone | 200 g |

The test results are shown in Table 4.

TABLE 4

| | Item | | | | |
|---|---|---|---|---|---|
| | Image-receiving resinous layer | | Printing property | | |
| Example No. | $R_{max}$ (μm) | Bekk smoothness (sec) | Imaging sensitivity | Highest color density | Resistance to fuse-adhesion |
| Example | | | | | |
| 6 | 0.6 | 2500 | 4 | 5 | 5 |
| 7 | 0.7 | 3100 | 5 | 5 | 4 |
| Comparative Example | | | | | |
| 6 | 0.8 | 2700 | 3 | 4 | 4 |
| 7 | 0.9 | 2800 | 4 | 3 | 2 |

SYNTHESIS EXAMPLE 3

Preparation of Copolyester Resin-5

The same procedures as in Synthesis Example 1 were carried out except that the dicarboxylic acid component and the diol component had the following compositions.

| Compound | Amount |
|---|---|
| (1) Dicarboxylic acid component | |
| Terephthalic acid | 60 molar % (99.7 g) |
| Isophthalic acid | 40 molar % (66.5 g) |
| (2) Diol component | |
| Ethylene glycol | 20 molar % (12.4 g) |
| Neopentyl glycol | 10 molar % (11.6 g) |
| Aromatic diol (UNIOL DA400) | 70 molar % (280.0 g) |

Also, the polycondensation was carried out at a temperature of 260° C. for 4 hours.

The properties of the resultant copolyester-5 are shown in Table 5.

SYNTHESIS EXAMPLE 4

Preparation of Copolyester Resin-6

The same procedures as in Synthesis Example 3 were carried out except that the diol component had the following composition.

(1) Dicarboxylic acid component
The same as in synthesis Example 3.
(2) Diol component

| Compound | Amount |
|---|---|
| Ethylene glycol | 40 molar % (24.8 g) |
| Neopentyl glycol | 20 molar % (23.1 g) |
| Aromatic diol (UNIOL DA400) | 40 molar % (160.0 g) |

Also, the polycondensation was carried out at a temperature of 240° C. for 4 hours.

The properties of the resultant copolyester resin-6 are shown in Table 5.

Comparative Polyester Resin-7

Trademark: POLYESTER 1051

Number average molecular weight: 15,000

The properties of the comparative polyester resin-7 are shown together with those of the above-mentioned comparative polyester resin-3 (VILON 290) in Table 5.

TABLE 5

| | | Item | | |
|---|---|---|---|---|
| Resin | | Number average molecular weight | Melt viscosity (Pa · S) (by MELT FLOW TESTER) 140° C. | 160° C. |
| Copolyester resin | 5 | 23,000 | $6 \times 10^6$ | $3 \times 10^5$ |
| Copolyester resin | 6 | 16,000 | $2 \times 10^5$ | $5 \times 10^4$ |
| Comparative polyester | 3 | 24,000 | $7 \times 10^6$ | $5 \times 10^5$ |
| Comparative polyester | 7 | 15,000 | $6 \times 10^5$ | $1.2 \times 10^5$ |

EXAMPLE 8

The same procedures as in Example 6 were carried out except that the coating liquid for the image-receiving resinous layer had the following composition.

| Component | Weight |
|---|---|
| Copolyester resin-5 | 100 g |
| Cross-linking agent (CORONATE L)(*)3 | 2 g |
| Silicone resin (SH3476) | 10 g |
| Toluene | 200 g |
| Methylethylketone | 200 g |

Note:
(*)3 . . . The molar ratio of cross-linking functional radicals to the copolyester resin-5 was 4.2.

The test results are shown in Table 6.

EXAMPLE 9

The same procedures as in Example 8 were carried out except that the composition of the coating liquid for the image-receiving resinous layer was as follows.

| Component | Weight |
|---|---|
| Copolyester resin-6 | 100 g |
| Cross-linking agent(*)4 | 10 g |
| Toluene | 200 g |
| Methylethylketone | 200 g |

Note:
(*)4 . . . Difunctional tolylene diisocyate

The test results are shown in Table 6.

EXAMPLE 10

The same procedures as in Example 8 were carried out except that the coating liquid for the image-receiving resinous layer had the following composition.

| Component | Weight |
|---|---|
| Copolyester resin-5 | 100 g |
| Cross-linking agent (CORONATE L) | 2 g |
| Silicone resin (SH3476) | 3 g |
| Toluene | 200 g |
| Methylethylketone | 200 g |

The test results are shown in Table 6.

COMPARATIVE EXAMPLE 8

The same procedures as in Example 8 were carried out, except that the coating liquid for the image-receiving resinous layer had the following composition.

| Component | Weight |
|---|---|
| Comparative polyester-3 | 100 g |
| Silicone resin (SH3476) | 3 g |
| Toluene | 200 g |
| Methylethyl resin | 200 g |

The test results are shown in Table 6.

COMPARATIVE EXAMPLE 9

The same procedures as in Example 8 were carried out except that the coating liquid for the image-receiving resinous layer had the following composition.

| Component | Weight |
|---|---|
| Comparative polyester-7 | 100 g |
| Cross-linking agent (CORONATE L) | 5 g |
| Silicone resin (SH3476) | 3 g |
| Toluene | 200 g |
| Methylethylketone | 200 g |

The test results are indicated in Table 6.

TABLE 6

| | Item | | | | |
|---|---|---|---|---|---|
| | Image-receiving resinous layer | | Printing property | | |
| Example No. | $R_{max}$ (μm) | Bekk smoothness (sec) | Color depth of images | Resistance to fuse-adhesion | Storage-durability (60° C., 48 h) |
| Example | | | | | |
| 8 | 0.8 | 3000 | 5 | 5 | 5 |
| 9 | 0.8 | 2800 | 4 | 4 | 4 |
| 10 | 0.8 | 3000 | 5 | 5 | 5 |
| Comparative Example | | | | | |
| 8 | 0.9 | 2500 | 5 | 3 | 2 |
| 9 | 0.7 | 3300 | 3 | 3 | 2 |

EXAMPLE 11

An image-receiving sheet was produced as follows.

A multilayered, oriented porous polyolefin film with a thickness of 150 μm available under the trademark of YUPO FPG 150 from OJI YUKA GOSEISHI K.K., and composed of monoaxially and biaxially oriented polyolefin films each consisting of a mixture of a polyolefin resin and 35% by weight of an inorganic pigment, was used as a substrate sheet.

A front surface of the substrate sheet was coated with a coating liquid (1) having the following composition, to provide an electroconductive intermediate layer having a dry basis weight of 0.5 g/m$^2$.

| Coating liquid (1) | |
|---|---|
| Component | Amount (part by wt.) |
| Cationic acrylic copolymer(*)5 | 100 |
| Methyl alcohol | 100 |
| Water | 200 |

Note:
(*)5 . . . An electroconductive material available under the trademark of ST-1000, from Mitsubishi YUKA K.K.

The back surface of the substrate sheet was coated with a coating liquid (2) having the following composition, to form an additional back coating layer having a dry basis weight of 1.0 g/m$^2$.

| Coating liquid (2) | |
|---|---|
| Component | Amount (part by wt.) |
| Acrylic ester copolymer emulsion(*)6 | 100 |
| Epoxy resin(*)7 | 5 |
| Cationic acrylic polymer(*)8 | 20 |
| Methyl alcohol | 100 |

-continued

| Coating liquid (2) | |
|---|---|
| Component | Amount (part by wt.) |
| Water | 200 |

Note:
(*)6 . . . Available under the trademark of PRIMAL WL-81, from RHOM AND HASS CO.
(*)7 . . . Available under the trademark of EPOCOAT DX-255, from SHELL KAGAKU K.K.
(*)8 . . . Available under the trademark of ST-3100, from MITSUBISHI YUKA K.K.

The surface of the electroconductive intermediate layer was coated with a coating liquid (3) having the following composition to form an image-receiving resinous layer having a dry basis weight of 5.0 g/m$^2$.

| Coating liquid (3) | |
|---|---|
| Component | Amount (part by wt.) |
| Polyester resin(*)9 | 100 |
| Polyester-silicone varnish(*)10 | 5 |
| Toluene | 200 |
| Methylethylketone | 200 |

Note:
(*)9 . . . A dye-receiving polyester resin available under the trademark of Vylon 200, from TOYOBO CORP.
(*)10 . . . Available under the trademark of KR-5203 from SHINETSU SILICONE K.K.

The surface inherent resistivity of the resultant image-receiving resinous layer was measured by using a surface high resistivity tester available under the trademark of HIRESTA MODEL HT-210 from MITSUBISHI YUKA K.K., at a temperature of 20° C. and a relative humidity of 50%.

The frictional electrocharging property of the resultant image-receiving sheets was evaluated by an organoleptic test by rubbing a front surface of an image-receiving sheet with a backsurface of another image-receiving sheet under predetermined conditions.

Also, the resultant image receiving sheets were subjected to a color printing test by using a sublimating dye thermal transfer color video printer (trademark: VY-25, HITACHI LTD.), to print a color test pattern.

The color density of the printed colored images was determined by using a color densitometer (trademark: MACBETH COLOR DENSITOMETER RD-914).

The test results are shown in Table 7.

EXAMPLE 12

The same procedures as in Example 11 were carried out except that the electroconductive intermediate layer was formed from a coating liquid (4) having the following composition.

| Coating liquid (4) | |
|---|---|
| Component | Amount (part by wt.) |
| Cationic acrylic copolymer(*)11 | 100 |
| Ethylalcohol | 100 |
| Water | 200 |

Note:
(*)11 . . . An electroconductive material available under the trademark of ST-2100, from MITSUBISHI YUKA K.K.

The test results are shown in Table 7.

COMPARATIVE EXAMPLE 10

The same procedures as in Example 11 were carried out except that the electroconductive intermediate layer was omitted.

The test results are shown in Table 7.

COMPARATIVE EXAMPLE 11

The same procedures as in Example 11 were carried out except that the image-receiving resinous layer was formed from the coating liquid (2) on the front surface of the substrate sheet and then the electroconductive layer was formed from the coating liquid (1) on the surface of the image-receiving resinous layer.

In the formation of the electroconductive layer, the coating liquid (1) partially covers the image-receiving resinous layer surface, because the coating liquid (1) was repelled by the image-receiving resinous layer surface.

The test results are shown in Table 7.

COMPARATIVE EXAMPLE 12

The same procedures as in Example 11 were carried out, with the following exceptions.

The front surface of the substrate sheet was directly coated with a coating liquid (5) having the following composition to form an image-receiving resinous layer with a dry basis weight of 5 g/m$^2$.

| Coating liquid (5) | |
|---|---|
| Component | Amount (part by wt.) |
| Polyester resin (VYLON 200) | 100 |
| Toluene | 200 |
| Methylethylketone | 200 |

The resultant image-receiving resinous layer was coated with a coating liquid (6) with the following composition to form an additional front coating layer with a dry basis weight of 1.0 g/m$^2$.

| Coating liquid (6) | |
|---|---|
| Component | Amount (part by wt.) |
| Polyestersilicone varnish (KR-5203) | 50 |
| Cationic acrylic copolymer (ST-2100) | 50 |
| Toluene | 200 |
| Methylethylketone | 200 |

The test results are shown in Table 7.

TABLE 7

| | Item | | | | |
|---|---|---|---|---|---|
| | Image-receiving resinous layer | | Surface inherent resistivity | Resistance to frictional electro-charging | Color density of images |
| Example No. | $R_{max}$ | Bekk smoothness (sec) | (Ω · cm) | | |
| Example | | | | | |
| 11 | 0.7 | 4400 | $4.2 \times 10^{10}$ | 5 | 5 |
| 12 | 0.7 | 5200 | $7.8 \times 10^{10}$ | 5 | 5 |
| Comparative Example | | | | | |
| 10 | 0.9 | 3000 | $1.5 \times 10^{13}$ | 1 | 5 |
| 11 | 0.8 | 2800 | $4.0 \times 10^{9}$ | 5 | 1 |
| 12 | 0.9 | 2500 | $2.0 \times 10^{9}$ | 2 | 2 |

We claim:

1. A thermal transfer image-receiving sheet comprising:

a substrate sheet; and at least one image-receiving resinous layer formed on at least one surface of the substrate sheet and comprising a dye-receiving resinous material, a surface of said image-receiving resinous layer having a surface roughness wave form with a maximum wave height ($R_{max}$) of 1.0 μm or less at a wave length of 0.1 to 2 mm.

2. The image-receiving sheet as claimed in claim 1, wherein the image-receiving resinous layer has a thickness of 1 to 20 μm.

3. The image-receiving sheet as claimed in claim 1, wherein the dye-receiving resinous material comprises a member selected from polyester resins, epoxy resins, polycarbonate resins, polyamide resins, polyvinyl acetate resins, and polyvinyl chloride resins.

4. The image-receiving sheet as claimed in claim 1, wherein the front surface of the substrate sheet is coated with the image-receiving resinous layer and the back surface of the substrate sheet is coated with an additional back coating layer comprising a synthetic resin and an electroconductive material or antistatic agent.

5. The image-receiving sheet as claimed in claim 1, wherein said substrate sheet comprises a core sheet and two film layers respectively formed on the front and back surfaces of the core sheet, each of said film layers comprising a single or multiple layered, monoaxially or biaxially oriented resinous film comprising, as a principal component, a mixture of a polyolefin resin with an inorganic pigment.

6. The image-receiving sheet as claimed in claim 5, wherein a surface of the core sheet, on which the image-receiving resinous layer is located through the film layer, has a Bekk smoothness of 1000 seconds or more.

7. The image-receiving sheet as claimed in claim 5, wherein the core sheet comprises a member selected from non-coated fine paper sheets, coated paper sheets, and thermoplastic resin films.

8. The image-receiving sheet as claimed in claim 5, wherein the core sheet has a thickness of 4 to 300 μm.

9. The image-receiving sheet as claimed in claim 5, wherein the polyolefin resin comprises at least one member selected from polyethylene resins, polypropylene resins and ethylene-α-olefin copolymers.

10. The image-receiving sheet as claimed in claim 5, wherein the pigment comprises at least one member selected from calcium carbonate, titanium dioxide and silica.

11. The image-receiving sheet as claimed in claim 5, wherein the pigment is present in an amount of 1 to 65% based on the weight of the polyolefin resin.

12. The image-receiving sheet as claimed in claim 5, wherein the front film layer has a thermal shrinkage measured at a temperature of 100° C. in accordance with JIS K6734, not higher than that of the back film layer.

13. The image-receiving sheet as claimed in claim 5, wherein the front film layer has a thickness of 30 to 100 μm but is not thinner than the back film layer.

14. The image-receiving sheet as claimed in claim 1, wherein the image-receiving resinous layer is formed by coating a coating liquid comprising the dye-receiving resinous material on the surface of the substrate sheet by a doctor blade coating method and solidifying the coated coating liquid layer, and the surface of the image-receiving resinous layer satisfies the relationship (I):

$$1.05 \geqq Gt/Gy \geqq 0.75 \quad (I)$$

wherein Gt represents a gloss of the image-receiving resinous layer surface measured along the doctor blade coating direction, and Gy represents a glossiness of the image-receiving resinous layer surface measured along a direction at a right angle to the doctor blade coating direction, and has a Bekk smoothness of 500 seconds or more.

15. The image-receiving sheet as claimed in claim 1, wherein the coating liquid has a Newtonian viscosity of 50 to 10,000 cP at the coating temperature.

16. The image-receiving sheet as claimed in 1, wherein the dye-receiving resinous material of the image-receiving resinous layer comprises at least one member selected from polyester resins having a glass transition temperature of from 40° C. to 70° C. and a modulus of elasticity of $5\times10^8$ Pa or more at a temperature of 60° C., and cross-linked polyester resins prepared by cross-linking the above-mentioned polyester resins with a cross-linking compound having two or more functional radicals reactive to the polyester resins, in an amount of 3 to 20 molar equivalents of the reactive radicals per mole of the polyester resin.

17. The image-receiving sheet as claimed in claim 16, wherein the polyester resin is a polycondensation product of a dicarboxylic acid component comprising at least terephthalic acid with a diol component comprising ethylene glycol and at least one aromatic diol compound.

18. The image-receiving sheet as claimed in claim 16, wherein the polyester resin has a number average molecular weight of 8,000 or more.

19. The image-receiving sheet as claimed in claim 1, wherein the dye-receiving resinous material of the image-receiving resinous layer comprises at least one cross-linked polymer having recurring ester units and exhibiting a melt viscosity of $10^6$ Pa.S or more at a temperature of 140° C. and of $10^5$ Pa.S or more at a temperature of 160° C.

20. The image-receiving sheet as claimed in claim 19, wherein the polyester unit-containing polymer has a number average molecular weight of 10,000 or more and a glass transition temperature of 50° C. or more.

21. The image-receiving sheet as claimed in claim 19, wherein the ester unit-containing polymer is selected from polyacrylic ester, polyvinyl acetates, and polycondensation products of dicarboxylic acid components comprising at last terephthalic acid with diol components comprising ethylene glycol and at least one aromatic diol compound.

22. The image-receiving sheet as claimed in claim 1, which further comprises an electroconductive intermediate layer arranged between the substrate sheet and the image-receiving resinous layer.

23. The image-receiving sheet as claimed in claim 22, wherein the electroconductive intermediate layer comprises, as a principal component, at least one cationic resin selected from cationic acrylic and methacrylic-copolymer resins, and in a dry solid weight of 0.05 to 3.0 $g/m^2$.

24. The image-receiving sheet as claimed in claim 22, wherein the image-receiving resinous layer located on the electroconductive intermediate layer exhibits a surface inherent resistivity of $10^{11}$ Ω.cm or less at a temperature of 20° C. and at a relative humidity of 50%.

* * * * *